US006173703B1

(12) United States Patent
Matsumoto

(10) Patent No.: US 6,173,703 B1
(45) Date of Patent: Jan. 16, 2001

(54) AIR-FUEL RATIO CONTROL APPARATUS FOR THE INTERNAL COMBUSTION

(75) Inventor: Norio Matsumoto, Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/322,972

(22) Filed: Jun. 1, 1999

(30) Foreign Application Priority Data

Apr. 3, 1999 (JP) ..... 11-056739

(51) Int. Cl.[7] ..... F02D 41/00
(52) U.S. Cl. ..... 123/674; 123/698
(58) Field of Search ..... 123/678, 674, 123/520

(56) References Cited

U.S. PATENT DOCUMENTS

| | | | | |
|---|---|---|---|---|
| 5,626,122 | | 5/1997 | Azuma . | |
| 5,706,654 | * | 1/1998 | Nagai | 123/674 |
| 5,758,631 | * | 6/1998 | Teraoka | 123/674 |
| 5,778,859 | * | 7/1998 | Takagi | 123/674 |
| 5,868,117 | * | 2/1999 | Moote et al. | 123/674 |
| 5,944,003 | * | 8/1999 | Osanai | 123/698 |
| 6,092,515 | * | 7/2000 | Morikawa | 123/698 |
| 6,102,003 | * | 8/2000 | Hyodo et al. | 123/698 |

FOREIGN PATENT DOCUMENTS

| | | |
|---|---|---|
| 5-52139 | 3/1993 | (JP) . |
| 6-200804 | 7/1994 | (JP) . |
| 8-261038 | 10/1996 | (JP) . |

* cited by examiner

*Primary Examiner*—John Kwon
(74) *Attorney, Agent, or Firm*—Sughrue, Mion, Zinn, Macpeak & Seas, PLLC

(57) ABSTRACT

An air-fuel ratio control apparatus for an internal combustion engine calculates a purge rate from a purge amount and an engine operating state, calculates a purge air density from the purge rate and an air-fuel ratio correcting coefficient, and calculates a purge air density correcting coefficient based on the purge rate and the purge air density. Further, the air-fuel ratio control apparatus calculates a learned air-fuel ratio feedback correction value from the air-fuel ratio feedback correcting coefficient, calculates a fuel injection amount based on the air-fuel ratio feedback correcting coefficient, the learned air-fuel ratio feedback correction value and the purge air density correcting coefficient, and alternately switches over the learning of the air-fuel ratio feedback correction and the learning of the purge air density. With this arrangement, when purge control is carried out, the air-fuel ratio control apparatus can control the air-fuel ratio of a mixture to be introduced into the internal combustion engine to a target value with excellent accuracy at all times.

6 Claims, 14 Drawing Sheets

FIG. 5

PURGE CONTROL VALVE BASIC TURN-ON TIME
PRGBSE (Ne, Ec)

UNIT : [ms]

| CHARGING EFFICIENCY Ec [%] | NUMBER OF REVOLUTIONS PER MINUTE Ne [rpm] | | | | | | | |
|---|---|---|---|---|---|---|---|---|
| | 1000 | 1250 | 1500 | 2000 | 2500 | 3000 | 3500 | 4000 |
| 6.25 | 0 | 0 | 0 | 0 | 13 | 15 | 20 | 20 |
| 12.50 | 0 | 0 | 0 | 0 | 23 | 26 | 30 | 37 |
| 18.75 | 15 | 18 | 21 | 27 | 34 | 39 | 46 | 54 |
| 25.00 | 19 | 23 | 27 | 36 | 43 | 50 | 60 | 70 |
| 37.50 | 29 | 36 | 42 | 56 | 68 | 80 | 93 | 107 |
| 50.00 | 46 | 57 | 68 | 90 | 103 | 120 | 143 | 167 |
| 62.50 | 80 | 100 | 120 | 158 | 200 | 214 | 255 | 255 |
| 75.00 | 255 | 255 | 255 | 255 | 255 | 255 | 255 | 255 |

PURGE FLOW RATE REFERENCE VALUE
PRGBSE (Ne, Ec)

UNIT : [g/sec]

| CHARGING EFFICIENCY Ec [%] | NUMBER OF REVOLUTIONS PER MINUTE Ne [rpm] | | | | | | | |
|---|---|---|---|---|---|---|---|---|
| | 1000 | 1250 | 1500 | 2000 | 2500 | 3000 | 3500 | 4000 |
| 6.25 | 0.000 | 0.000 | 0.000 | 0.000 | 0.075 | 0.087 | 0.102 | 0.120 |
| 12.50 | 0.000 | 0.000 | 0.000 | 0.000 | 0.146 | 0.178 | 0.204 | 0.234 |
| 18.75 | 0.089 | 0.111 | 0.133 | 0.176 | 0.224 | 0.269 | 0.311 | 0.359 |
| 25.00 | 0.121 | 0.148 | 0.178 | 0.238 | 0.293 | 0.350 | 0.414 | 0.477 |
| 37.50 | 0.179 | 0.226 | 0.265 | 0.356 | 0.445 | 0.535 | 0.623 | 0.720 |
| 50.00 | 0.240 | 0.300 | 0.358 | 0.481 | 0.582 | 0.701 | 0.831 | 0.975 |
| 62.50 | 0.294 | 0.368 | 0.442 | 0.581 | 0.736 | 0.856 | 1.000 | 1.066 |
| 75.00 | 0.260 | 0.153 | 0.166 | 0.179 | 0.268 | 0.260 | 0.191 | 0.278 |

AIR-FUEL RATIO CONTROL APPARATUS FOR THE INTERNAL COMBUSTION

BACKGROUND OF THE INVENTION

1. Field of the Invention

The present invention relates to an air-fuel ratio control apparatus for an internal combustion engine. More particularly, the present invention pertains to an air-fuel ratio control apparatus provided with an air-fuel ratio feedback control function and a purge control function.

2. Description of the Related Art

The evaporated fuel, which is generated from a fuel tank and the like, has been adsorbed by activated charcoal and purged into an air intake system.

Further, there are internal combustion engines which carry out air-fuel ratio feedback control so that the air-fuel ratio of a gas mixture in a fuel injector is made to a stoichiometric value.

In these internal combustion engines, when the evaporated fuel is not purged, an air-fuel ratio feedback correcting coefficient varies around, for example, 1.0. However, when a purging operation is started, the air-fuel ratio feedback correcting coefficient is set to a smaller value because a fuel injection amount must be reduced by the amount of the evaporated fuel having been purged.

The deviation of the air-fuel ratio feedback correcting coefficient from a reference value during purging operation takes various values, depending upon the operating state of the internal combustion engine, that is, according to the ratio of the amount of intake air to the amount of purge air. The air-fuel ratio feedback correcting coefficient is set so as to relatively slowly change with a given integration constant to avoid an abrupt change in the air-fuel ratio. When the purge rate is changed by a transient engine operation and the like while the purging operation is being carried out, it takes some time for the purge rate to settle to a certain value after the change of the purge rate from the value before the change thereof, so that the air-fuel ratio cannot be maintained to the stoichiometric value during that time.

To cope with the above problem, Japanese Patent Laid-Open No. 5-52139 proposes the following apparatus. That is, an internal combustion engine disclosed therein includes a first injecting amount correction means for correcting a fuel injection amount by an air-fuel ratio feedback correcting coefficient, a purge air density calculation means for calculating a purge air density per a unit target purge rate based on the deviation of the air-fuel ratio feedback correcting coefficient, which would be caused when purging operation is carried out, and a second injecting amount correction means for reducing a fuel amount based on the product of the purge air density and the purge rate when the purging operation is carried out. In the internal combustion engine, a maximum purge rate, which is the ratio of the purge amount to the intake air amount with a purge control valve being fully opened, is previously stored, the duty factor or ratio of the purge control valve is set to the ration of a target purge rate to a maximum purge rate, and when the purging operation is started, a target duty ratio is gradually increased. When the air-fuel ratio feedback correcting coefficient is equal to or less than a prescribed value and an air-fuel ratio is on a rich side, a purge air density coefficient is increased stepwise by each given value. In addition, the deviation of the air-fuel ratio feedback correcting coefficient is reflected on the purge air density coefficient at a prescribed rate at each 15 seconds after the start of the purging operation. With this operation, the air-fuel ratio feedback correcting coefficient is forcibly caused to approach 1.0. As described above, the duty ratio of the purge control valve is controlled so that the purge rate is made constant regardless of the operating state of the engine. In addition, even if the purge rate is changed, the deviation of the air-fuel ratio during transient engine operation is prevented by correcting the injection amount by the product of the purge rate and the purge air density.

However, even if the duty ratio of the purge control valve is controlled so that the purge rate is made constant, and even if the injection amount is controlled by the product of the purge rate and the purge air density, a certain period of time is necessary until the air-fuel ratio feedback correcting rate is made to 1.0. Accordingly, there arises a problem that the air-fuel ratio cannot be maintained to the stoichiometric value in the state in which the purge air density has not yet completely been calculated, that is, when a purge-cut state is shifted to a purged state, or when the state, in which a purge rate of several percentages is secured with a medium load, is shifted to the state, in which the purge rate is approximately zero with a high load, or vice versa.

To solve the above problem, Japanese Patent Laid-Open No. 8-261038, which was previously filed by the applicant, proposes an air-fuel ratio control apparatus for an internal combustion engine which can control the air-fuel rate of a mixture to be introduced into the internal combustion engine to a target value with excellent accuracy at all times. That is, the air-fuel ratio control apparatus comprises a purge rate calculation means for calculating a purge rate of purge air from the purge amount thereof, which is calculated by a purge amount calculation means and from the operating state of the engine, which is detected by an operating state detection means, a purge air density calculation means for calculating a purge air density from the purge rate and an air-fuel ratio feedback correcting coefficient, a purge air density correction means for calculating a purge air density correcting coefficient based on the purge rate and the purge air density, and a fuel injection amount calculation means for calculating a fuel injection amount which is supplied to the internal combustion engine based on the air-fuel ratio feedback correcting coefficient and the purge air density correcting coefficient. The air-fuel ratio control apparatus calculates the purge air density from a deviation of the air-fuel ratio feedback correcting coefficient and from the purge rate when a purging operation is carried out, calculates the purge air density correcting coefficient based on the purge air density and the purge rate, and calculates a fuel injection amount, which is supplied to the internal combustion engine, based on the air-fuel ratio feedback correcting coefficient and the purge air density correcting coefficient.

The air-fuel ratio control apparatus controls the air-fuel ratio feedback correcting coefficient to a target value by correcting the fuel injection amount according to the purge rate and the purge air density. Further, the air-fuel ratio control apparatus calculates a learned purge air density value by subjecting the purge air density, which is calculated by the purge air density calculating means, to filter processing. When the purge air density is calculated for the first time after the engine is started, the air-fuel ratio control apparatus uses the result of the calculation as the learned purge air density value without subjecting the purge air density to the filter processing. When the purge rate is equal to or less than a prescribed value, the air-fuel ratio control apparatus prohibits the update or renewal of the purge air density. Furthermore, after the purge air density has been calculated, the air-fuel ratio control apparatus makes the increasing rate of the purge amount, which is gradually increased after the start of the internal combustion engine, greater than the increasing rate thereof before the purge air density has been calculated.

However, the conventional air-fuel ratio control apparatus has the following disadvantages.

1) Although the purge air density is sufficiently learned, the opportunity for learning the air-fuel ratio feedback is not sufficiently secured. That is, the opportunity for learning the air-fuel ratio feedback is less than the opportunity for learning the purge air density, and both the opportunities are not equally provided.

2) During the time when the air-fuel ratio feedback is being learned, a sufficient flow rate of purge air cannot be secured.

3) When the density of purge air has not yet been learned, it is impossible to suppress variations in the air-fuel ratio due to introduction of purge air. In addition, when the purge air density has been learned, a sufficient flow rate of purge air cannot be secured.

4) Variations in the air-fuel ratio, which would be caused by a deviation between the learned purge air density value and an actual purge air density value during continued non-introduction of purge air, cannot be prevented.

SUMMARY OF THE INVENTION

In view of the above, the present invention is intended to obviate the above-mentioned various problems of the prior art, and has for its object to provide an air-fuel ratio control apparatus for an internal combustion engine which is capable of ensuring a sufficient opportunity for learning air-fuel ratio feedback so as to make it equal or near to the opportunity for learning a purge air density.

Another object of the present invention is to provide an air-fuel ratio control apparatus for an internal combustion engine which is capable of ensuring a sufficient or certain purge air flow rate during the time when the air-fuel ratio feedback is being learned.

A further object of the present invention is to provide an air-fuel ratio control apparatus for an internal combustion engine which is capable of suppressing variations in the air-fuel ratio of a mixture upon introduction of purge air when the purge air density has not yet been learned, and which is also capable of ensuring a sufficient or certain purge air flow rate when the purge air density has been learned.

A still further object of the present invention is to provide an air-fuel ratio control apparatus for an internal combustion engine which is capable of effectively preventing variations in the air-fuel ratio of a mixture due to a deviation between a learned purge air density value and an actual purge air density during continued non-introduction of purge air.

According to an aspect of the present invention, there is provided an air-fuel ratio control apparatus for an internal combustion engine, comprising: an operating state detection means for detecting an operating state of the internal combustion engine; a purge amount control means for controlling an amount of evaporated fuel in a fuel tank to be introduced into an engine intake system based on an output of said operating state detection means; a purge amount calculation means for calculating a purge amount of the evaporated fuel to be introduced into the engine intake system by said purge amount control means; a purge rate calculation means for calculating a purge rate based on the purge amount calculated by said purge amount calculation means and based on the engine operating state detected by said operating state detection means; an air-fuel ratio sensor for detecting an air-fuel ratio of a mixture supplied to the internal combustion engine; an air-fuel ratio control means for controlling an air-fuel ratio feedback correcting coefficient, which corrects the air-fuel ratio of the mixture to be supplied to the internal combustion engine, based on an output of said air-fuel ratio sensor so as to make the air-fuel ratio to a target value; a purge air density calculation means for calculating a purge air density based on the purge rate and the air-fuel ratio feedback correcting coefficient; a purge air density correction means for calculating a purge air density correcting coefficient based on the purge rate and the purge air density; a learned air-fuel ratio feedback correcting value calculation means for calculating a learned air-fuel ratio feedback correcting value from the air-fuel ratio feedback correcting coefficient; a fuel injection amount calculation means for calculating a fuel injection amount to be supplied to the internal combustion engine based on the air-fuel ratio feedback correcting coefficient, the learned air-fuel ratio feedback correcting coefficient and the purge air density correcting coefficient; and a switching determination means for alternately switching over between a learning of air-fuel ratio feedback correction and a learning of purge air density.

In a preferred form of the invention, the introduction of purge air is ordinarily prohibited when the air-fuel ratio feedback is learned, whereas when the purge air, density is low, air-fuel ratio feedback control is carried out while introducing purge air.

In another preferred form of the invention, when the purge air density is low, priority is given to the learning of the air-fuel ratio feedback to thereby increase the learning rate of the air-fuel ratio.

In a further preferred form of the invention, the learning rate of the air-fuel ratio is changed based on the number of times the air-fuel ratio has been learned in each of engine operating zones.

In a still further preferred form of the invention, when a purge air non-introducing mode is switched over to a purge air introducing mode at the time the purge air density has not yet been learned, a purge air flow rate is gradually increased.

In a yet further preferred form of the invention, provision is made for a learned purge air density value resetting determination means for resetting or correcting a learned purge air density when detecting the generation of a large amount of evaporated fuel in the fuel tank.

The above and other objects, features and advantages of the present invention will become more readily apparent to those skilled in the art from the following detailed description of presently preferred embodiments of the invention taken in conjunction with the accompanying drawings.

BRIEF DESCRIPTION OF THE DRAWINGS

FIG. 5 shows maps of a purge control valve basic turn-on time and a purge flow rate reference value;

DESCRIPTION OF THE PREFERRED EMBODIMENTS

Now, presently preferred embodiments of the present invention will be described below with reference to the accompanying drawings.

Figure 1:
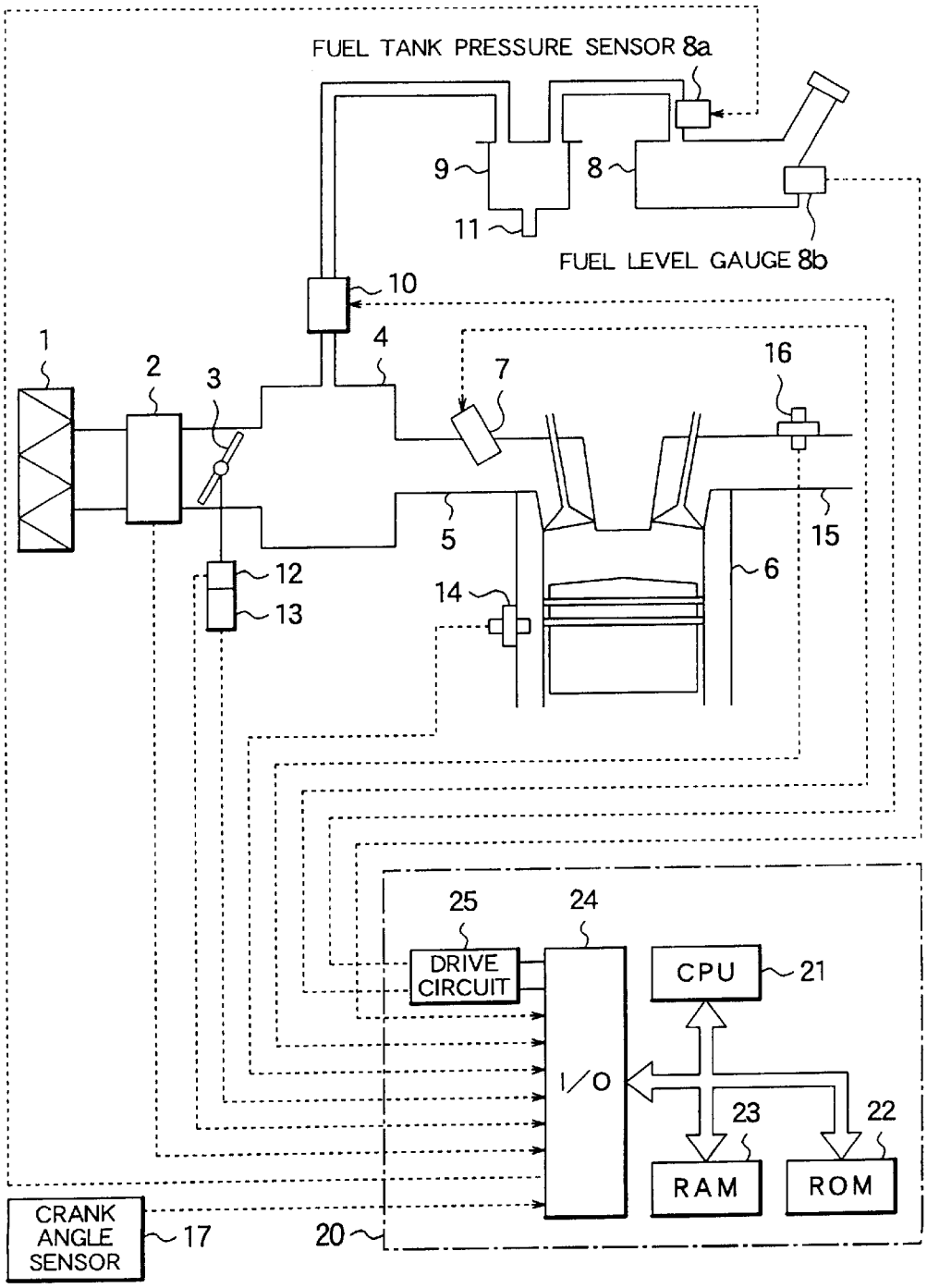
FIG. 1 is a block diagram showing the arrangement of an air-fuel ratio control apparatus for an internal combustion engine according to the present invention.

FIG. 1 is a block diagram schematically showing the arrangement of an air-fuel ratio control apparatus for an internal combustion engine according to the present invention. Referring to FIG. 1, the amount Qa of intake air, which has been cleaned by an air cleaner 1 and supplied therefrom to an intake system, is measured by an air flow sensor 2, and the amount of intake air is controlled by a throttle valve 3 in accordance with an engine load. Then, the intake air is sucked into the respective cylinders of an internal combustion engine (hereinafter simply referred to as an engine) 6 through a surge tank 4 and a suction pipe 5. On the other hand, the fuel from a fuel tank 8 is injected into the suction pipe 5 through an injector 7. Further, the evaporated fuel generated in the fuel tank 8 is adsorbed to a canister 9, in which activated charcoal is contained. A purge control valve 10 is opened in accordance with the purge valve control amount, which is determined depending upon the operating state of the engine 6. At the time, the evaporated fuel, which has been adsorbed, is purged into the surge tank 4 as the air containing the evaporated fuel, which has been separated from the activated charcoal, that is, as purge air, when the air, which has been introduced from a canister atmosphere port 11 due to the negative pressure in the surge tank 4, passes through the activated charcoal in the canister 9.

An engine control unit 20, which carries out various kinds of control such as air-fuel ratio control, ignition timing control and the like, is composed of a microcomputer, which includes a CPU 21, a ROM 22, a RAM 23 and the like. The engine control unit 20 receives, through an input/output interface 24, an amount of intake air Qa which is measured by the air flow sensor 2, a degree of opening θ of the throttle valve 3 which is measured by a throttle sensor 12, a signal from an idle switch 13 which is turned on when the throttle valve 3 is set to a degree of opening of idling, an engine cooling water temperature WT which is detected by a water temperature sensor 14, an air-fuel ratio feedback signal 02 from an air-fuel ratio sensor 16 provided on an exhaust pipe 15, the number of revolutions per minute of engine Ne which is detected by a crank angle sensor 17, the pressure of the evaporated gas in the fuel tank 8 which is detected by a fuel tank pressure sensor 8*a* provided on a purge passage for connecting the fuel tank 8 to the canister 9, the level of the fuel in the fuel tank 8 which is detected by a fuel level gauge 8*b* mounted on the fuel tank 8, and so on. The sensors such as the air flow sensor 2, the throttle sensor 12, the idle switch 13, the water temperature sensor 14, the air-fuel ratio sensor 16, the crank angle sensor 17 and the like constitute an operating state detection device.

The CPU 21 carries out calculations for air-fuel ratio feedback control based on a control program and various maps stored in the ROM 22 and drives the injector 7 through a driving circuit 25.

The engine control unit 20 carries out various kinds of control such as fuel injection control, ignition timing control, EGR control, idling speed or rpm control, and the like. In addition to the above control, the engine control unit 20 carries out various kinds of control in accordance with the operating states of the engine. More specifically, when, for example, the engine cooling water temperature WT is higher than a prescribed value after the completion of engine warming-up operation with the number of revolutions of engine Ne being greater than a prescribed value, the engine control unit 20 purges the canister 9 as described above by outputting a canister purge signal and driving the purge control valve 10. Then, when the engine 6 is in idling operation, the engine control unit 20 detects it through the signal from the idle switch 13 and turns off the purge control valve 10 to thereby cut or interrupt the canister purge.

Figure 2:
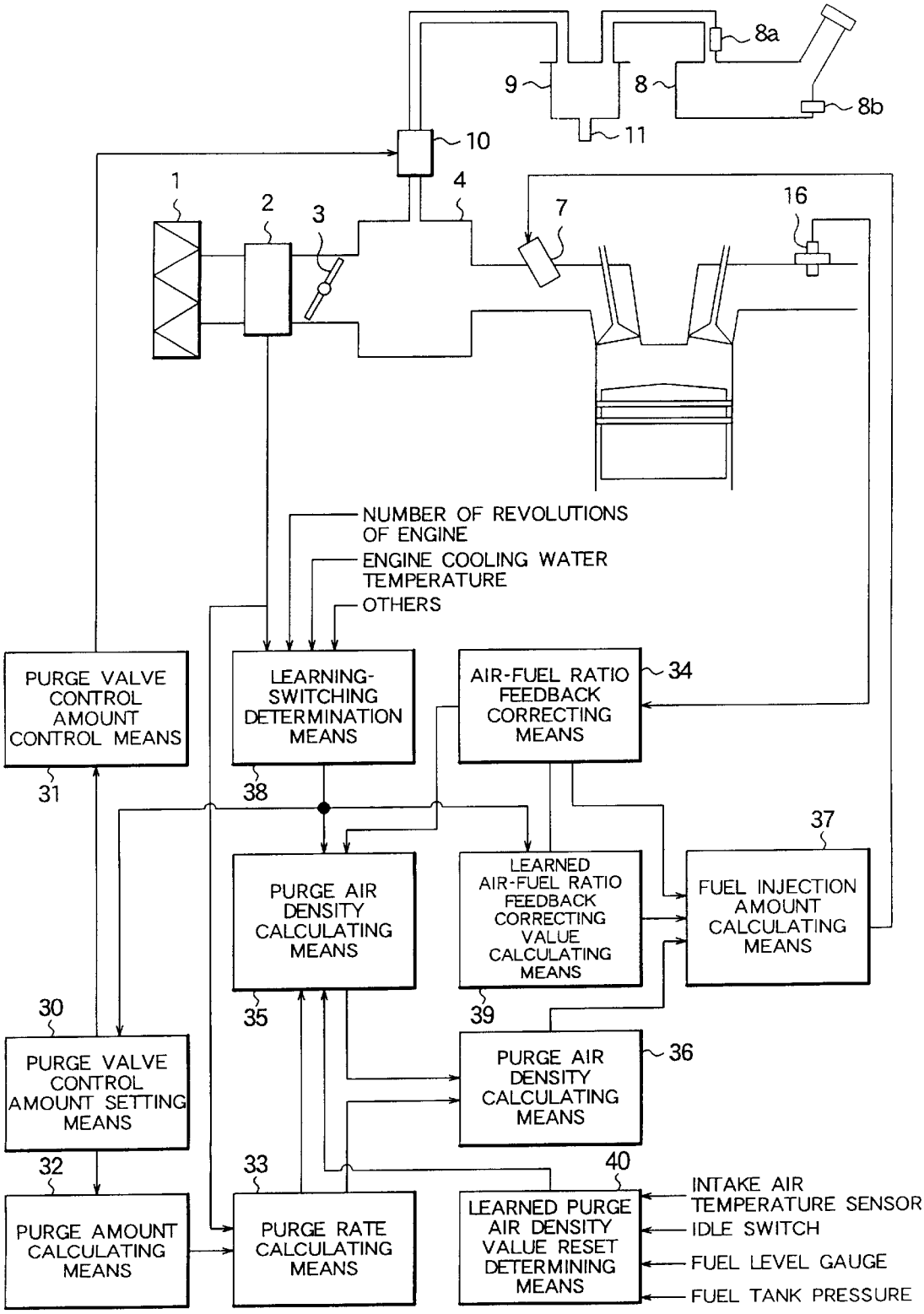
FIG. 2 is a block diagram showing the control block of the air-fuel ratio control apparatus of the present invention.

FIG. 2 is a block diagram showing the arrangement of the control block of the air-fuel ratio control apparatus of the present invention. Referring to FIG. 2, a purge valve control amount setting means 30 detects the operating state of the engine 6 based on the information obtained from the sensors and sets the purge amount which is determined by the engine operating state. A purge valve control amount control means 31 controls the rate or degree of opening of the purge control valve 10 in accordance with the purge amount set by the purge valve control amount setting means 30. The purge valve control amount setting means 30 and the purge valve control amount control means 31 together constitute a purge amount control means. A purge amount calculating means 32 calculates the purge amount of air to be introduced into the suction pipe 5 based on the purge valve control amount set by the purge valve control amount control means 31. A purge rate calculating means 33 calculates a purge rate based on the amount of intake air, which is detected by the air flow sensor 2, and based on the purge amount, which is calculated by the purge amount calculating means 32. An air-fuel ratio feedback correcting means 34 serves as an air-fuel ratio control means and calculates an air-fuel ratio feedback correcting coefficient for correcting a fuel injection amount based on the output, which is detected by the air-fuel ratio sensor 16, so that the air-fuel ratio is set to a target air-fuel ratio. A purge air density calculating means 35 calculates a purge air density based on the purge rate and a deviation of the air-fuel ratio feedback correcting coefficient, which would take place during purging operation. A purge air density correcting means 36 calculates a purge air density correcting coefficient for correcting the fuel injection amount based on the purge air density and the purge rate during purging operation. A fuel injection amount calculating means 37 calculates the fuel injection amount based on the air-fuel ratio feedback correcting coefficient and the purge air density correcting coefficient. A learning-switching determination means 38 determines whether switching must be carried out between a learning of air-fuel ratio feedback correction and a learning of purge air density based on the number of revolutions of engine, the engine cooling water temperature and the like. A learned air-fuel ratio feedback correcting value calculating means 39 calculates a learned air-fuel ratio feedback correcting value in response to the outputs from the air-fuel ratio feedback correcting means 34 and the learning-switching determination means 38. A learned purge air density value reset determining means 39 determines whether a learned purge air density is to be reset or corrected based on the detection of a large amount of evaporated gas which is generated during the time when the engine is idling at a high temperature.

In the internal combustion engine shown in FIG. 2, the amount of fuel to be injected or fuel injection amount Qf is basically calculated from the following formula.

$$Qf=\{(Qa/Ne)/AFR_T\}\times C_{FB}\times C_{PRG}\times K+\alpha \quad (1)$$

In the formula (1), the respective constants are defined as shown below.

Qa: an intake air amount

Ne: the number of revolutions of engine $AFR_T$: a target air-fuel ratio $C_{FB}$: an air-fuel ratio feedback correcting coefficient $C_{PRG}$: a purge air density correcting coefficient K: a first correction coefficient $\alpha$: a second correction coefficient The first correction coefficient represented at K is used in the multiplication of a warming-up correction coefficient and the like. The second correction coefficient represented at $\alpha$ is used to increase the fuel injection amount in the case of acceleration and the like. When correction is not necessary, K is ordinarily set to 1.0 and $\alpha$ is set to 0. The purge air density correcting coefficient $C_{PRG}$ corrects, when purge is carried out, the fuel injection amount based on the purge air density and the purge rate. When the purge is not carried out, the coefficient $C_{PRG}$ is set to 1.0. The air-fuel ratio feedback correcting coefficient $C_{FB}$ controls the air-fuel ratio to the target air-fuel ratio $AFR_T$ based on an signal which is output from the air-fuel ratio sensor 16. Although any air-fuel ratio may be used as the target air-fuel ratio $AFR_T$, a theoretical air-fuel ratio is used as the target air-fuel ratio $AFR_T$ in this embodiment.

It has been described above that when the air-fuel ratio is deviated from the target air-fuel ratio $AFR_T$ under the purge control or the like, the correction of the air-fuel ratio to the target air-fuel ratio $AFR_T$ is time-consuming even if it is corrected using the air-fuel ratio feedback correcting coefficient $C_{FB}$. The reason is that the coefficient $C_{FB}$ is set so as to change relatively slowly with a given integration constant.

To cope with the above problem, formula (1) above has carefully been considered, and according to the present invention, the air-fuel ratio during purge control is controlled to the target air-fuel ratio $AFR_T$ by updating or renewing the purge air density correcting coefficient $C_{PRG}$. At this time, the air-fuel ratio feedback correcting coefficient $C_{FB}$, which changes relatively slowly and takes some time to correct the air-fuel ratio to the target air-fuel ratio, is maintained to a prescribed value.

Consequently, a deviation of the air-fuel ratio from the target air-fuel ratio can be effectively suppressed which would otherwise be caused during the time when the air-fuel ratio is being corrected to the target air-fuel ratio with the slowly changing air-fuel ratio feedback correcting coefficient $C_{FB}$. Thus, the air-fuel ratio can be promptly controlled to the target air-fuel ratio.

When the air-fuel ratio is on a rich side, the air-fuel ratio sensor 16 generates an output voltage of about 0.9 V, whereas, when the air-fuel ratio is on a lean side, the air-fuel ratio sensor 16 generates a voltage of about 0.1 V. First, how the air-fuel ratio feedback correcting coefficient $C_{FB}$ is controlled will be described. The control is carried out based on a signal which is output from the air-fuel ratio sensor 16.

Figure 3:
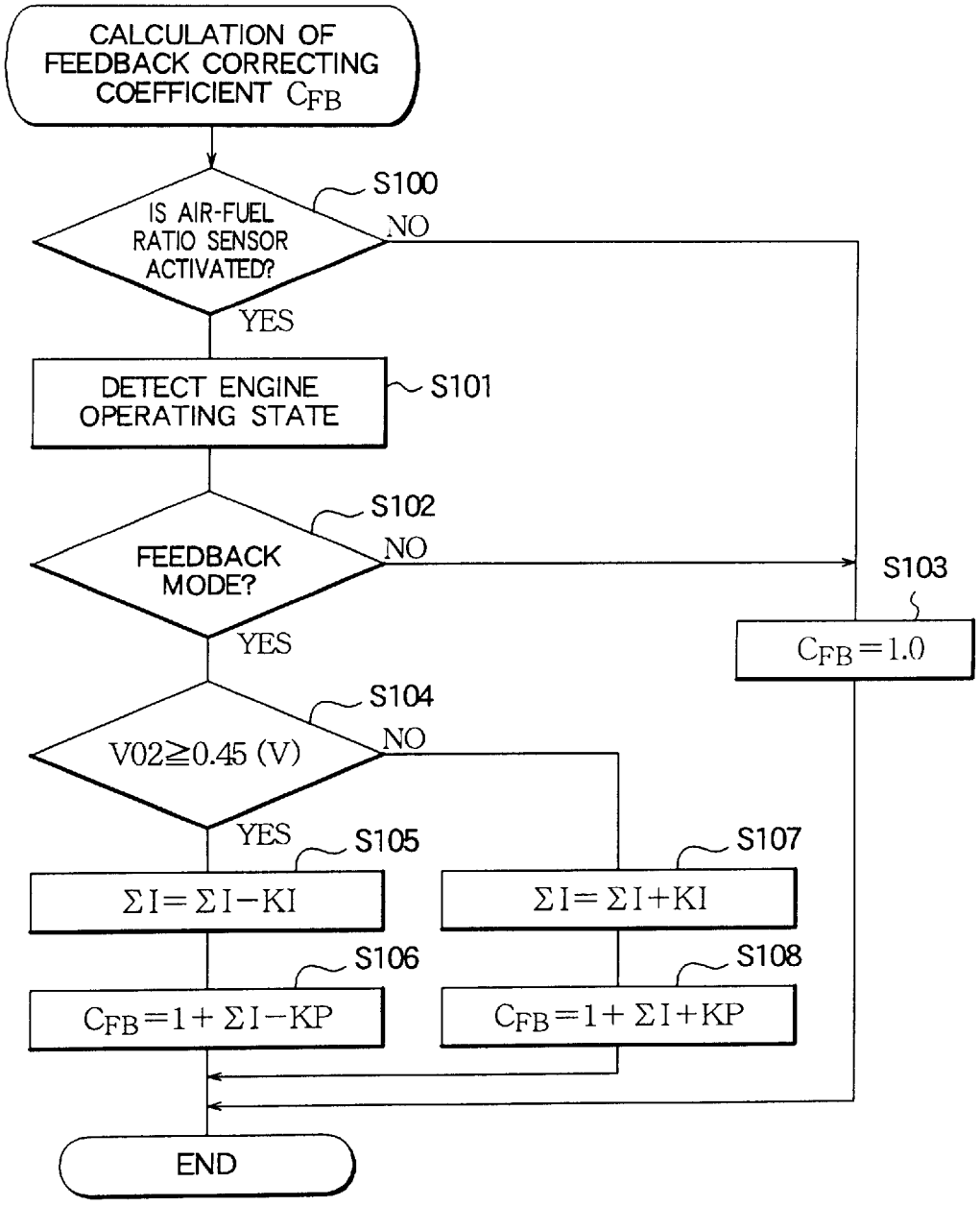
FIG. 3 is a flowchart showing how an air-fuel ratio feedback correcting coefficient is calculated.

FIG. 3 shows a routine for calculating the air-fuel ratio feedback correcting coefficient $C_{FB}$. First, in step S100, it is determined whether the air-fuel ratio sensor 16 is activated or not. When the air-fuel ratio sensor 16 is not activated, the process goes to step 103 in which $C_{FB}$ is set to 1.0 and the processing is then finished. On the other hand, when the air-fuel ratio sensor 16 is activated, the process goes to step S101 in which the engine control unit 20 captures the signals from the crank angle sensor 17, the air flow sensor 2, the throttle sensor 12, the water temperature sensor 14 and the like, and detects the operating state of the engine. Then, in step 102, it is determined from the engine operating state detected in step S101 whether the engine is operating in a feedback mode. If it is determined that the engine is out of the feedback mode, i.e., operating in a mode such as an enrich mode, a fuel cut-off mode, etc., other than the feedback mode, the process goes to step S103 in which $C_{FB}$ is set to 1.0 and thereafter the process is finished. In contrast, when the engine is operating in the feedback mode, it is determined in step S104 whether the voltage V02 output from the air-fuel ratio sensor 16 is equal to or higher than 0.45 (v), that is, the air-fuel ratio is on the rich side or not. If V02≧0.45 (v), that is, if the air-fuel ratio is on the rich side, the process goes to step S105 in which a relatively small integrated value Kl is subtracted from a sum of feedback integration correcting coefficients Σl. Next, in step S106, the air-fuel ratio feedback correcting coefficient $C_{FB}$ is calculated by subtracting a relatively large skip value KP from a value that is obtained by adding a sum of feedback integration correcting coefficients Σl calculated in step S105 to 1.0, which is the reference value of the air-fuel ratio feedback correcting coefficient $C_{FB}$.

In contrast, if it is determined in step S104 that V02<0.45 V, that is, if the air-fuel ratio is on the lean side, the process goes to step S107 in which the relatively small integrated value Kl is added to the sum of feedback integration correcting coefficients Σl. In the next step S108, the air-fuel ratio feedback correcting coefficient $C_{FB}$ is calculated by adding the relatively large skip value KP to the value that is obtained by adding the sum of feedback integration correcting coefficients Σl calculated in step S107 to 1.0 as the reference value of the air-fuel ratio feedback correcting coefficient $C_{FB}$.

The sum of feedback integration correcting coefficients Σl is a value which changes depending upon the state of the purge, although this is described later in detail.

Therefore, the air-fuel ratio feedback correcting coefficient $C_{FB}$ is corrected depending upon the state of the purge in steps S105 to S107.

As described above, when the air-fuel ratio is on the rich side, the air-fuel ratio feedback correcting coefficient $C_{FB}$ is reduced to thereby decrease the fuel injection amount. On the contrary, when the air-fuel ratio is on the lean side, the air-fuel ratio feedback correcting coefficient $C_{FB}$ is increased to thereby increase the fuel injection amount. As a result, the air-fuel ratio is maintained to the theoretical air-fuel ratio. When the purge control is not carried out, the air-fuel ratio feedback correcting coefficient $C_{FB}$ varies approximately around 1.0.

Next, the purge control will be described. In the internal combustion engine shown in FIG. 1, the purge control valve 10 is duty controlled in a drive cycle 100 ms by the engine control unit 20 through the driving circuit 25. A purge control valve turn-on time $T_{PRG}$ is calculated based on the following formula.

$$T_{PRG}=PRGBSE\times K_{PRG}\times Kx \quad (2)$$

In formula (2) above, the respective constants are defined as shown below.

PRGBSE: a purge control valve basic turn-on time $K_{PRG}$: an initial purge flow rate reducing coefficient Kx: a correction coefficient The correction coefficient Kx collectively shows the correction of the engine cooling water temperature and the correction of the intake air temperature. The correction coefficient Kx is ordinarily 1.0 after the engine has been warmed up. The purge control valve basic turn-on time PRGBSE is arranged as a two-dimensional map. The two-dimensional map is composed of the number of revolutions of engine Ne, which is calculated from the crank angle sensor 17, and a charging efficiency Ec, which is calculated from the number of revolutions per minute of engine Ne and the amount of intake air Qa measured by the air flow sensor 2. The turn-on time of the purge control valve is set so that a constant purge rate can be obtained. The initial purge flow rate reducing coefficient $K_{PRG}$ is a coefficient for correcting the initial purge air flow rate in a reducing direction in order to prevent a large amount of purge from being performed when it is unknown how much evaporated fuel is adsorbed by the canister. The initial purge flow rate reducing coefficient $K_{PRG}$ is calculated based on the following formula.

$$K_{PRG}=\min\{K_{KPRG}\times\Sigma Q_{PRG}, 1.0\} \quad (3)$$

The formula (3) means that the smaller of $K_{KPRG}\times\Sigma Q_{PRG}$ and 1.0 is employed. In the formula (3), the respective constants are defined as shown below.

$K_{KPRG}$: a gain of initial purge flow rate reducing coefficient $\Sigma Q_{PRG}$: a sum of purge amounts The sum of purge amounts $\Sigma Q_{PRG}$ is a sum of purge amounts after the engine has been started, and the initial value thereof after starting up of the engine is set to 0. The gain of initial purge flow rate reducing coefficient $K_{KPRG}$ is the rate at which the coefficient $K_{PRG}$ for reducing the initial purge air flow rate increases. Therefore, the operation of the coefficient $K_{PRG}$ for reducing initial purge air flow rate is such that as the purge proceeds after the engine has been started, the value of the coefficient $K_{PRG}$ is increased at the increasing rate of the gain of initial purge flow rate reducing coefficient $K_{KPRG}$, but limited to 1.0.

The operation of the coefficient $K_{PRG}$ for reducing the initial purge air flow rate permits the purge control valve turn-on time $T_{PRG}$ to take a value which is smaller than the purge control valve basic turn-on time PRGBSE upon starting up of the engine. Then, as the purge proceeds, the purge control valve turn-on time $T_{PRG}$ gradually increases up to the purge control valve basic turn-on time PRGBSE.

Figure 9:
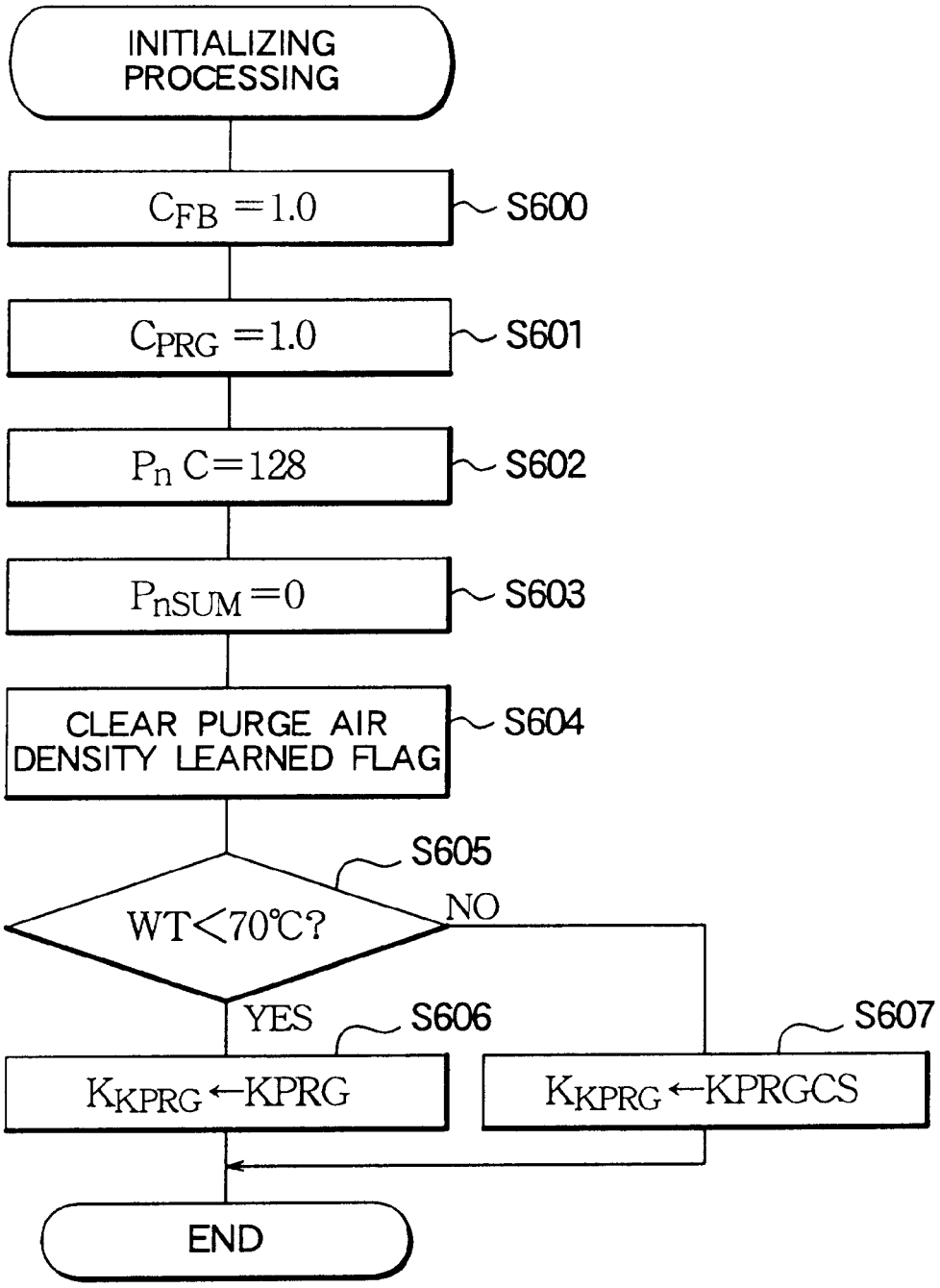
FIG. 9 is a flowchart illustrating initialization processing.

The gain $K_{KPRG}$ of the coefficient for reducing the initial purge air flow rate is set in steps S606 and 607 in the initializing processing routine shown in FIG. 9 and takes a different value depending upon the engine cooling water temperature when the engine is started.

FIG. 9 shows the initializing processing which is carried out when power is supplied to the engine control unit 20. Initial values are set to respective variables in steps S600 to step 603. In step S604, a purge air density learned flag is cleared. In steps 605 to S607, initial values are set to respective variables in accordance with the temperature of the engine.

In step S605, it is determined whether the engine has been warmed up or not. When the engine has not been warmed up, a predetermined value, which is used when the engine is started at a low temperature, is set to the gain $K_{KPRG}$ of the coefficient for reducing the initial purge air flow rate.

If it is determined that the engine has been warmed up in step S605, the process goes to step S607 in which the value of the gain $K_{KPRG}$ of the coefficient for reducing the initial purge air flow rate is set to a gain KPRGCS of the coefficient for reducing the initial purge air flow rate when the engine is started at a high temperature.

A gain KPRG taken when the engine is started at a high temperature and another gain KPRGCS taken when the engine is started at a low temperature have the following relationship.

gains: KPRG<KPRGCS

When the gas, which is evaporated from the fuel in the fuel tank 8, is likely to be removed from the canister 9 as the temperature of the canister 9 is increased by the warming up of the engine, the gain for determining the speed, at which the coefficient for reducing the purge air flow rate increases, is set to a small value because the amount of gas evaporated from the fuel to the canister 9 is unknown.

Figure 4:
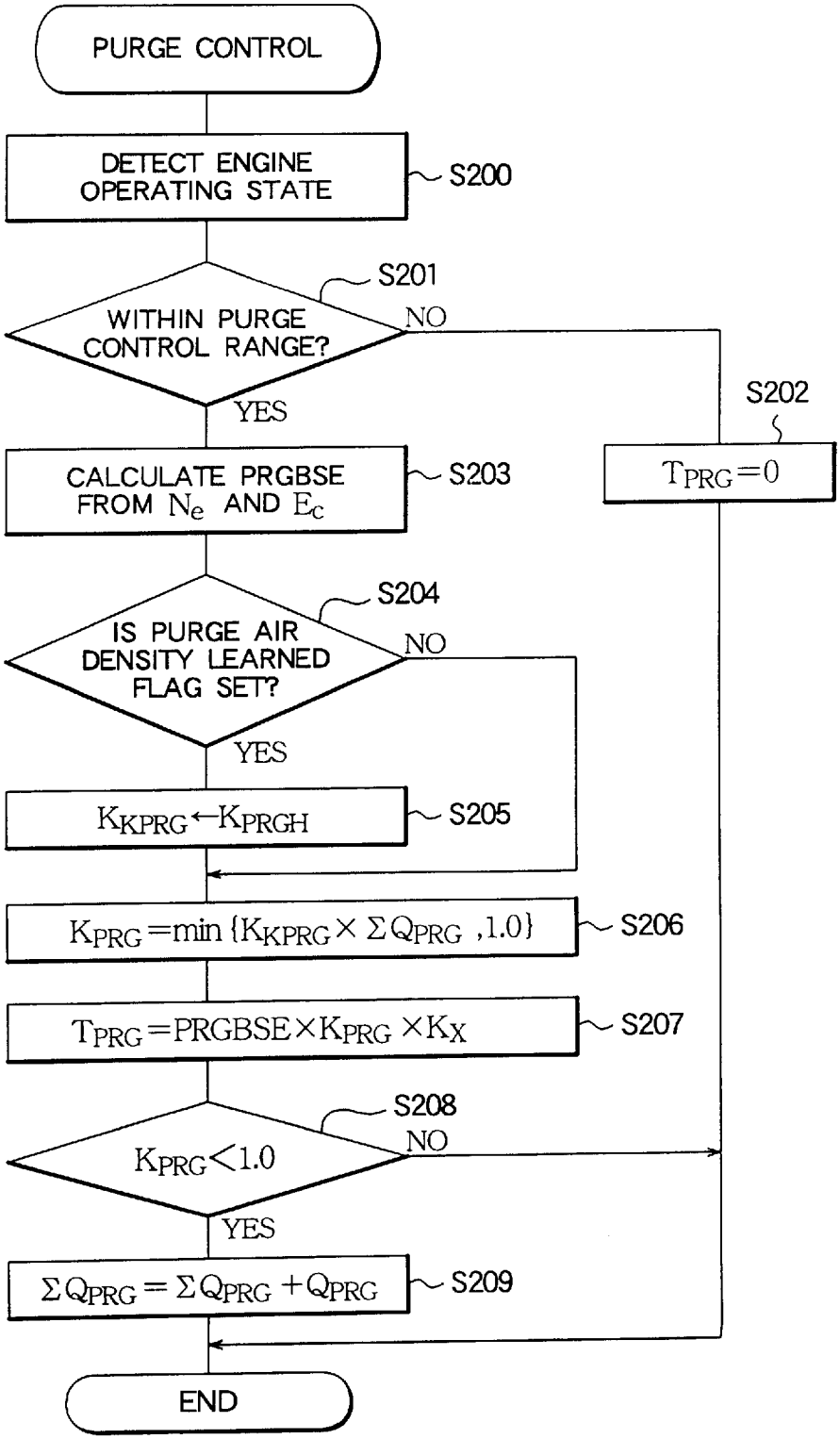
FIG. 4 is a flowchart illustrating purge control.

FIG. 4 shows a flowchart of purge control, which will be described in more detail with reference to FIG. 4. First, in step S200, the engine control unit 20 captures the signals from the crank angle sensor 17, the air flow sensor 2, the throttle sensor 12, the water temperature sensor 14, and the like and detects the operating state of the engine. Next, in step S201, it is determined from the operating state detected in step S200 whether the engine is operated within a purge controllable range or not. When the engine is not operated within the purge controllable range, the process goes to step S202. In step S202, $T_{PRG}$ is set to 0 [ms], that is, the purge control valve is closed and the process is finished. Whereas, when the engine is operated within the purge controllable range, the process goes to step S203. In step S203, the turn-on time of the purge control valve is calculated from the map of the purge control valve basic turn-on time PRGBSE in FIG. 5, which was previously stored, based on the number of revolutions per minute of engine Ne and the charging efficiency Ec. The purge flow rate reference value QPRGBSE shown in FIG. 5 is provided by mapping the purge air flow rates which were experimentally determined by controlling the purge control valve 10 by the control amount of the purge control valve basic turn-on time PRGBSE.

Then, in step S204, it is determined whether the purge air density learned flag is set or not. When the purge air density learned flag is not set, that is, when the purge air density is not yet learned, the process goes to step S206. On the contrary, when the purge air density learned flag is set, that is, when the purge air density has been learned, the process goes to step S205 and there resets the gain $K_{KPRG}$ of the coefficient for reducing the initial purge air flow rate, which was set in the initializing processing, to a gain KPRGH. The gain KPRGH is larger than the gain $K_{KPRG}$ which was set in the initializing processing. Accordingly, the purge control amount is increased faster after learning of the purge air density than when the purge air density is not learned. The reason is to introduce a larger amount of purge air, because the air-fuel ratio is not affected by the change of the purge rate after the purge air density has been learned.

Next, in step S206, the initial purge flow rate reducing coefficient $K_{PRG}$ is calculated, and in step S207, the purge control valve turn-on time $T_{PRG}$ is calculated based on the purge control valve basic turn-on time PRGBSE obtained in step S203 and the initial purge flow rate reducing coefficient $K_{PRG}$ obtained in step S206. Subsequently, in step S208, it is determined whether the initial purge flow rate reducing coefficient $K_{PRG}$ is less than 1.0 or not. If $K_{PRG} \geqq 1.0$, the process is finished, whereas, if $K_{PRG} < 1.0$, the process goes to step S209. In step S209, the purge amount $Q_{PRG}$ according to the turn-on time of the purge control valve, which was calculated in step S207, is added to a sum of purge amounts $\Sigma Q_{PRG}$, and the process is finished. How the purge amount $Q_{PRG}$ is calculated will be described in the following paragraph which will also explain the calculation of the purge rate Pr.

Figure 6:
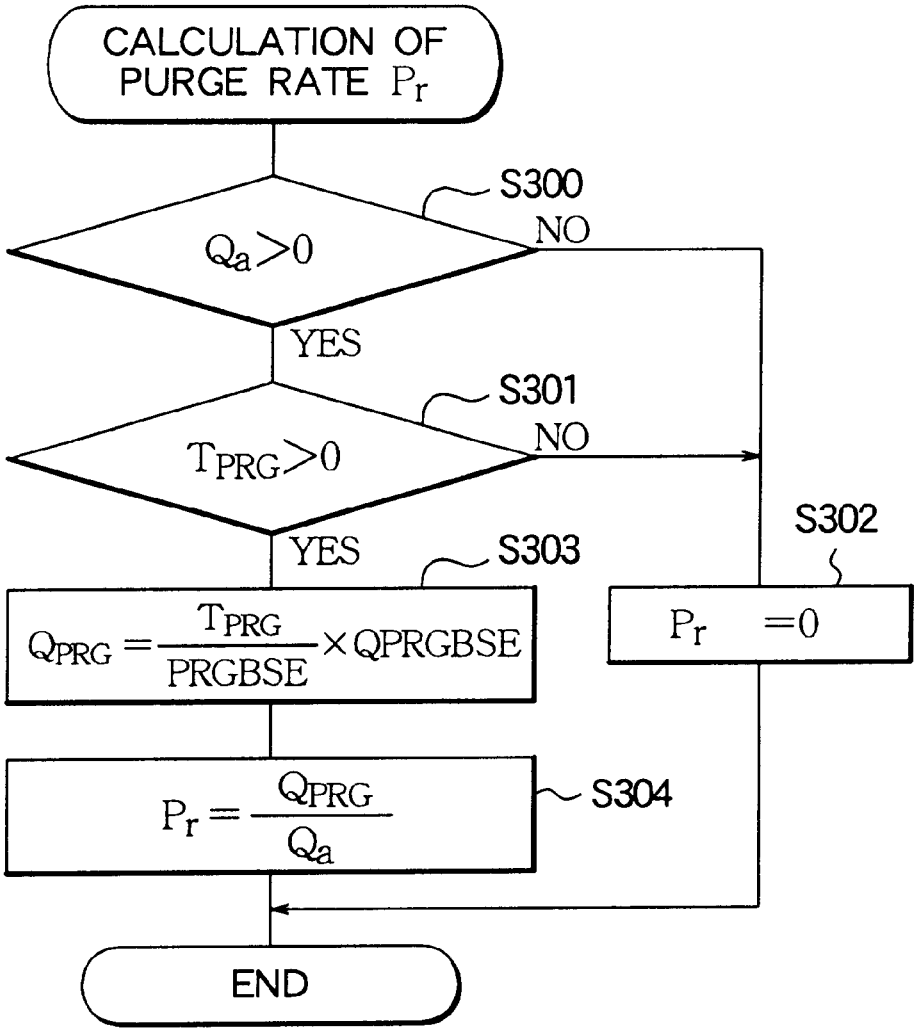
FIG. 6 is a flowchart illustrating how a purge rate is calculated.

Now, the way how to calculate the purge rate Pr will be described. FIG. 6 shows a flowchart for calculating the purge rate Pr. First, in step S300, it is determined whether the intake air amount Qa is greater than 0. If the intake air amount Qa $\leqq 0$, the purge rate Pr is set to 0 in step S302, and the process is finished. On the contrary, if the intake air amount Qa>0 in step S300, the process goes to step S301. In step S301, it is determined whether the purge control valve turn-on time $T_{PRG}$ is greater than 0. If the purge control valve turn-on time $T_{PRG} \leqq 0$, Pr is set to 0 in step S302, and the process is finished. On the other hand, if the purge control valve turn-on time $T_{PRG} > 0$, the process goes to step S303. In step S303, the purge amount $Q_{PRG}$ is calculated based on the purge control valve turn-on time $T_{PRG}$, the purge control valve basic turn-on time PRGBSE and the purge flow rate reference value QPRGBSE, as shown in FIG. 5. Finally, in step S304, the purge rate Pr is calculated based on the purge amount $Q_{PRG}$, which was calculated at the previous step S303 and the intake air amount Qa, and the process is finished. The routine for calculating the purge rate Pr is carried out each time the signal from the crank angle sensor 17 rises up.

Figure 7:
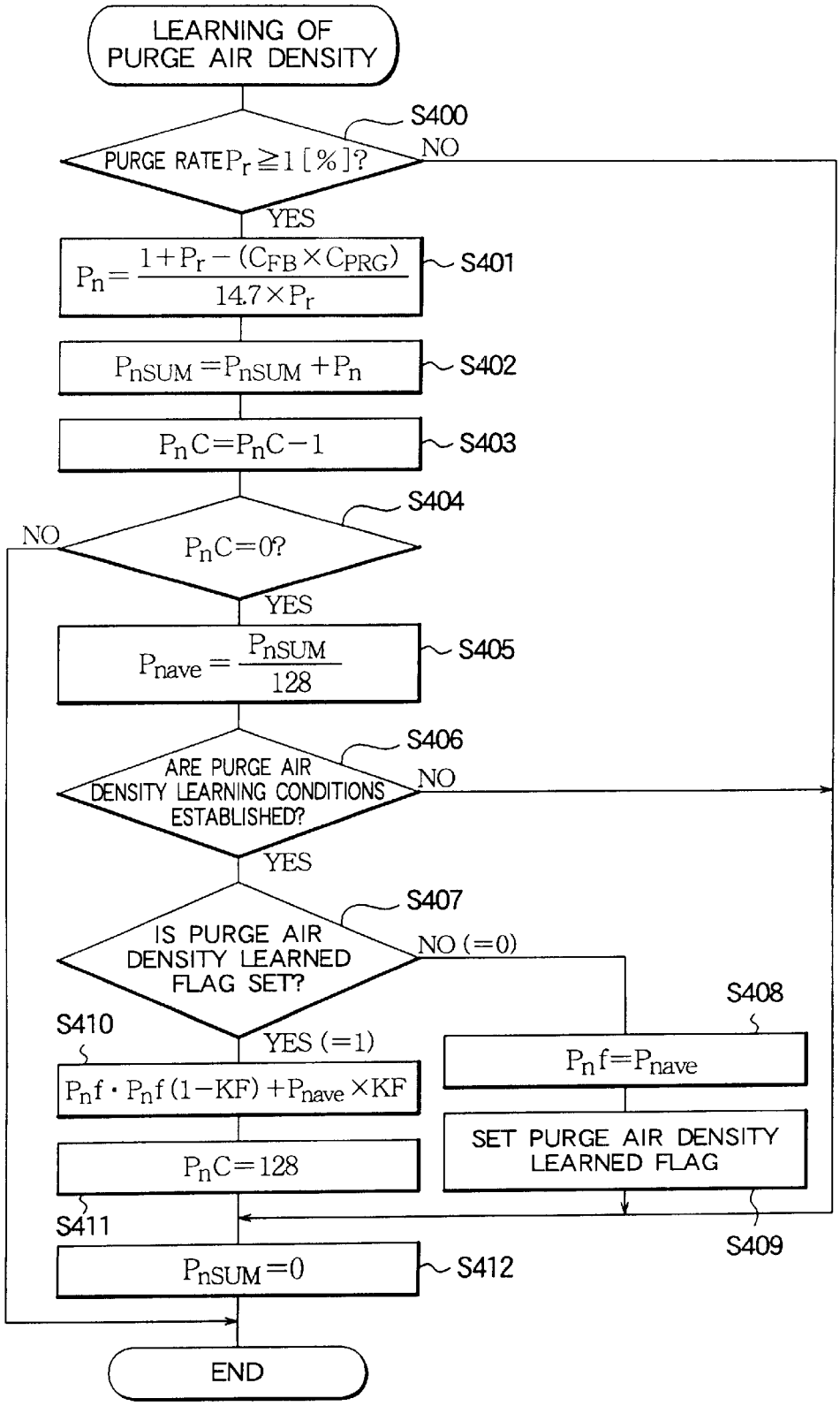
FIG. 7 is a flowchart illustrating how a purge air density is learned.

Next, the way how to learn the purge air density will be described. FIG. 7 shows a flowchart for learning the purge air density. At first, in step S400, it is determined whether the purge rate Pr is equal to or greater than 1 (%). If Pr<1 (%), the process goes to step S412 in which the sum of purge air densities PnSUM is set to 0, and the process is finished. If, however, the purge rate Pr÷1 (%), the process goes to step S401. The reason for not calculating the purge air density when Pr<1 (%) is that the error, which would be caused in the calculation of the purge air density, is increased by a smaller purge rate Pr when the air-fuel ratio is deviated due to factors other than the purge, for example, due to aged deterioration of the air flow sensor, variations in the characteristics of injectors, and the like.

Step S400 constitutes a prohibition means for prohibiting the update of the purge air density.

In step S401, the purge air density Pn is calculated based on the purge rate Pr, the air-fuel ratio feedback correcting coefficient $C_{FB}$, and the purge air density correcting coefficient $C_{PRG}$, which will be described later.

Subsequently, in step S402, the purge air density Pn, which was calculated in step 401, is added to the sum of purge air densities PnSUM. Then in step 403, a purge air density integration counter PnC is decremented, and in step S404, it is determined whether PnC is equal to 0. If PnC>0, the process is finished. If, however, PnC=0, the process goes to step S405. In step S405, the average purge air density value $Pn_{ave}$ is calculated from the sum of purge air densities PnSUM. The reason for dividing the sum of the purge air densities by 128 is that a purge air density counter is set to 128 in the initializing processing and the sum of purge air densities PnSUM is obtained by summing up the purge air densities 128 times. Since the routine for learning the purge air density is processed each time the signal from the crank angle sensor rises up, the average purge air density value $Pn_{ave}$ is updated or renewed each time the signal from the crank angle sensor rises up 128 times.

Subsequently, in step S406, it is determined whether purge air density learning conditions are established. If the purge air density learning conditions are not established, the process goes to step S412. In step S412, the sum of purge air densities PnSUM is set to 0, and the process is finished. On the contrary, if the purge air density learning conditions are established, the process goes to step S407. In step S407, it is determined whether the purge air density learned flag is set or not. When the flag is not set, it indicates that the purge air density is calculated for the first time after the engine has been started. Thus, the process goes to step S408 in which the average purge air density value $Pn_{ave}$, which was calculated in step S405, is set as a learned purge air density value Pnf. Then in step S409, the purge air density learned flag is set, and in step S412, the integrated value PnSUM of the purge air densities is set to 0. Thereafter, the process is finished. Thus, the actual learned purge air density value Pnf can be promptly obtained in such a manner that the average purge air density value $Pn_{ave}$ is set as the learned purge air density value Pnf without being subjected to filter processing. In contrast, when the purge air density learned flag is set in step S407, the process goes to step S410. In step S410, the learned purge air density value Pnf is calculated by subjecting the average value $Pn_{ave}$ of the purge air densities to the filter processing using a filter constant KF ($1>KF \geqq 0$). PnC is then set to 128 in step S411 and PnSUM is set to 0 in step S412. Thereafter, the process is finished.

The flowchart shown in FIG. 7 constitutes means for calculating a learned purge air density value.

Figure 8:
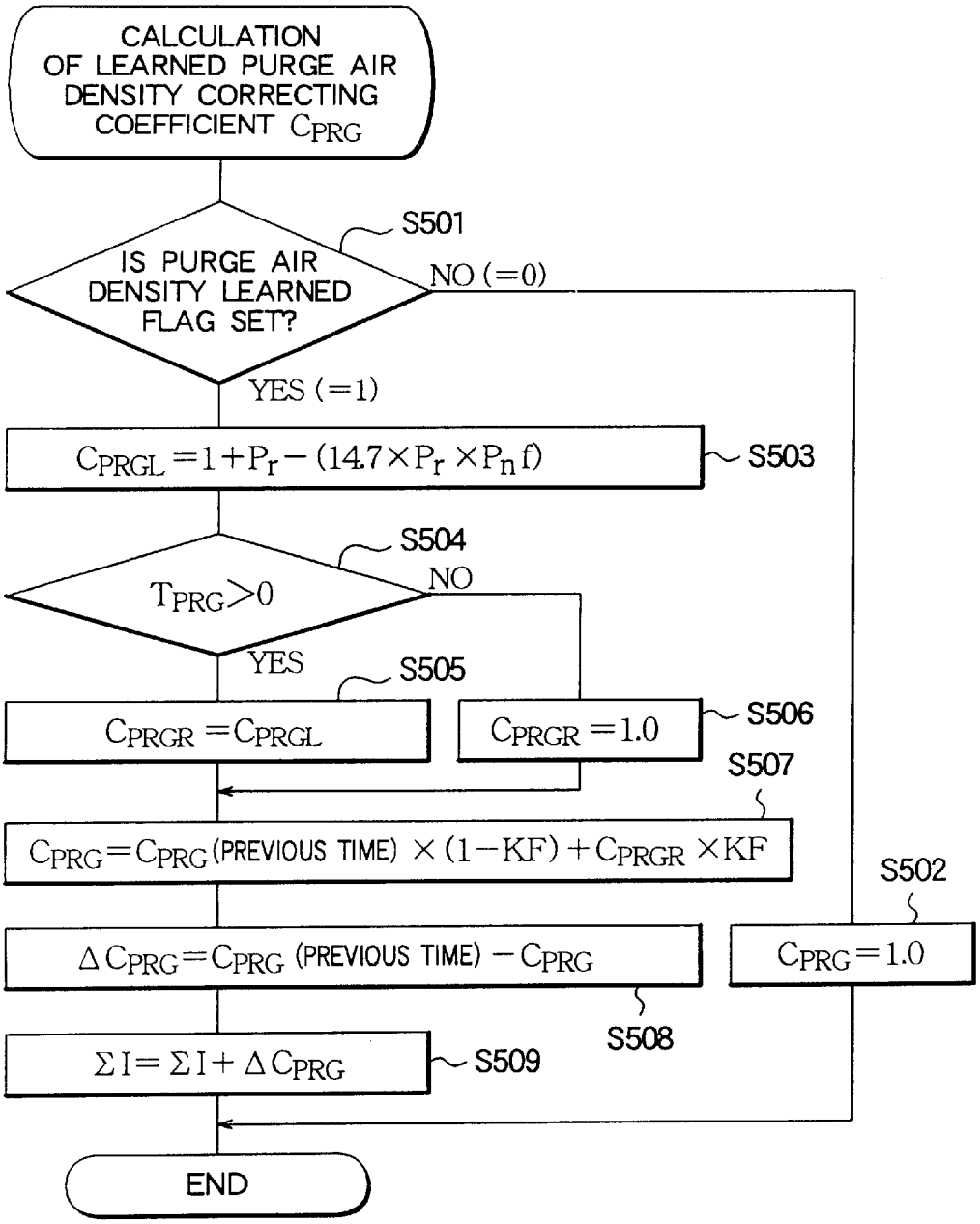
FIG. 8 is a flowchart illustrating how a learned purge air density correcting coefficient is calculated.

Now, the way how to calculate the purge air density correcting coefficient $C_{PRG}$ will be described while referring to a flowchart of FIG. 8. First, in step S501, it is determined whether the purge air density learned flag is set. When the flag is not set, that is, when the purge air density has not yet been learned, $C_{PRG}$ is set to 1.0 in step S502, and the process is finished. On the contrary, when the flag is set, that is, when the purge air density has been learned, the process goes to step S503. In step 503, an instantly learned purge air density value $C_{PRGL}$ is calculated based on the purge rate Pr and the learned purge air density value Pnf. In step S504, it is determined whether the purge control valve turn-on time $T_{PRG}$ is greater than 0. If $T_{PRG} \leqq 0$, the process goes to step S506 in which $C_{PRGR}$ is set to 0, and the process goes to step S507. on the other hand, if $T_{PRG} > 0$, the process goes to step S505. In step S505, the instantly learned purge air density value $C_{PRGL}$, which was calculated in step S503, is set as $C_{PRGR}$, and the process goes to step S507. In step S507, $C_{PRGR}$, which was determined in the previous process, is subjected to filtering using the filter constant KF ($1>KF \geqq 0$) to thereby calculate the learned purge air density correcting coefficient $C_{PRG}$.

Next, in step S508, that value is set as $\Delta C_{PRG}$ which is obtained by subtracting the currently obtained, learned purge air density correcting coefficient $C_{PRG}$ from the previously or last obtained, learned purge air density correcting coefficient $C_{PRG}$. Then, the process goes to step S509. In step S509, the value, which is obtained by subtracting $\Delta C_{PRG}$ determined in step S508 from the sum of feedback integration correcting coefficients $\Sigma l$, is set as a new sum of feedback integration correcting coefficients $\Sigma l$, and the process is finished.

The sum of feedback integration correcting coefficients $\Sigma l$ is used to calculate the air-fuel ratio feedback correcting coefficient $C_{FB}$.

Next, the operation of the air-fuel ratio control apparatus will be described using the timing chart shown in FIG. 10. The purge flow rate reducing coefficient $K_{PRG}$ is set to 0 until purge air is introduced after starting up of the engine. Purge control is started when the operation of the engine is stabilized into a steady state, that is, at the point a where the idle switch 13 is turned off. When the purge air beings to be introduced, the purge rate Pr and the sum of purge amounts $\Sigma Q_{PRG}$ are calculated, and the initial purge flow rate reducing coefficient $K_{PRG}$ is increased with a prescribed gradient.

After a prescribed number of ignitions (e.g., 128 ignitions in the illustrated example) have been carried out from the beginning of the purge control, the learned purge air density value Pnf is calculated as well as the learned purge air density correcting coefficient $C_{PRG}$ . Then, added to the air-fuel ratio feedback correcting coefficient $C_{FB}$ is $\Delta C_{PRG}$, which is obtained by subtracting the currently obtained coefficient for correcting the learned purge air density from the previously or last obtained coefficient for correcting the learned purge air density. Further, the increase in the purge flow rate reducing coefficient $K_{PRG}$ is limited to 1.0, and at the time, the calculation of the sum of purge amounts $\Sigma Q_{PRG}$ is interrupted.

When the idle switch 13 is turned off and the purge control is started (at point a), the purge control valve 10 is opened, and the learning execution counter incorporated in the learning-switching determination means 38 is counted down from an initial value (e.g., 12 in the illustrated example) to zero each time ignition is carried out a prescribed number of times (256 ignitions in the illustrated example). When the learning execution counter is counted down to zero, it is rest to the initial value. When the count value of the learning execution counter is set to a first prescribed value (e.g., 8 in the illustrated example), the purge control valve 10 is closed and the air-fuel ratio is learned. When the learning execution counter is set to a second prescribed value (e.g., 6 in the illustrated example), the purge control valve 10 is opened again and the purge air density is learned. Further, the purge air density learning counter, which is incorporated in the learning-switching determination means 38, starts counting simultaneously with the start of the purge control, and is counted up each time ignition is carried out the prescribed number of times (e.g., 128 ignitions in the illustrated example). While the purge control valve 10 is closed or when the purge air density learning conditions are not established (i.e., when the purge air density need not be learned because the air-fuel ratio is not controlled to the theoretical air-fuel ratio and the air-fuel ratio is not feedback controlled, as when the engine is accelerated or decelerated,), the purge air density learning counter is not counted up.

With the first embodiment, the learning of air-fuel ratio feedback correction and the learning of purge air density are alternately switched over. Thus, the opportunity for learning the air-fuel ratio feedback correction is made equal to the opportunity for learning the purge air density. As a result, both the purge control and the air-fuel ratio control can finely be carried out while establishing compatibility therebetween and taking account of the influences of the purge air on the air-fuel ratio upon introduction thereof. In this case, the learning of air-fuel ratio feedback correction and the learning of purge air density may be switched over at every prescribed time using a timer or the like in place of using the count value indicated by the learning execution counter.

Further, when the purge air density is low (i.e., when the learned purge air density value is equal to or less than a prescribed value (for example, 1%), the purge control valve 10 is opened by a prescribed percentage to thereby set the coefficient for reducing the purge air flow rate to a small value. Thus, the air-fuel ratio feedback is learned while introducing the purge air at a low purge rate. With this operation, an increase in pressure of the evaporated fuel gas in the fuel tank 8 can be effectively suppressed while ensuring a sufficient purge air flow rate even if the air-fuel ratio feedback control is carried out. At the same time, the air-fuel ratio feedback correction can be learned with a reduced error.

On the contrary, when the purge air density is high, the introduction of the purge air is prohibited and the learning of air-fuel ratio feedback is carried out to prevent a deviation of the air-fuel ratio, which would otherwise be caused by the fuel in the purge air.

Further, when the purge air is introduced at the time the purge air density has not yet been learned, the purge air amount is gradually increased by providing a time lag to the required amount of purge air. In contrast, when the purge air density has been learned, the purge air is immediately introduced without any time lag in order to ensure the required purge air flow rate. As described above, when a purge air non-introducing mode is switched to a purge air introducing mode at the time the purge air density has not yet been learned, variations in the air-fuel ratio, which would be caused, upon introduction of the purge air, by a deviation between the learned purge air density value and the actual value of the purge air density, can be effectively suppressed by gradually increasing the purge air flow rate.

Embodiment 2

Figure 10:
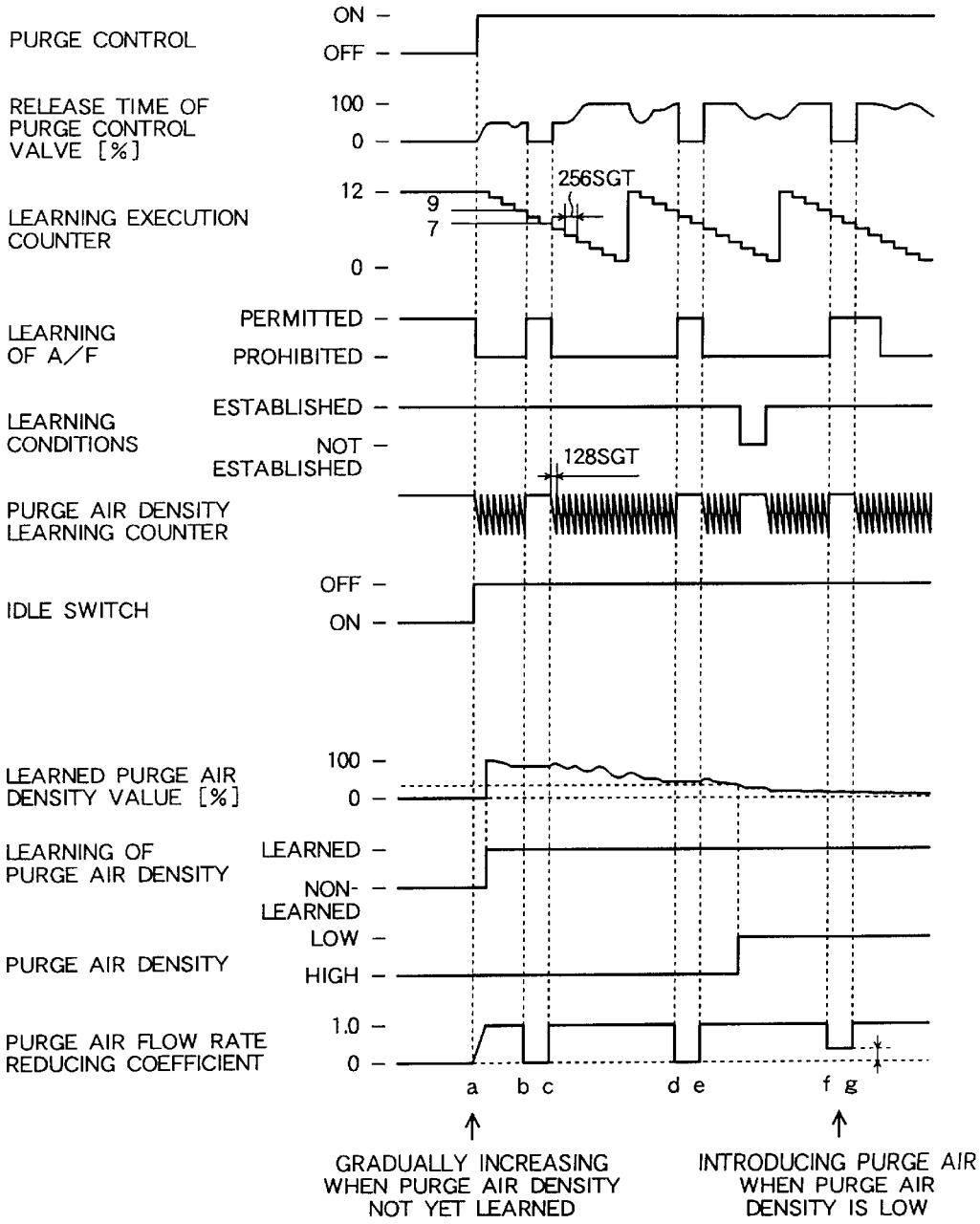
FIG. 10 is a timing chart illustrating the operation of an air-fuel ratio control apparatus according to a first embodiment of the present invention.
Figure 11:
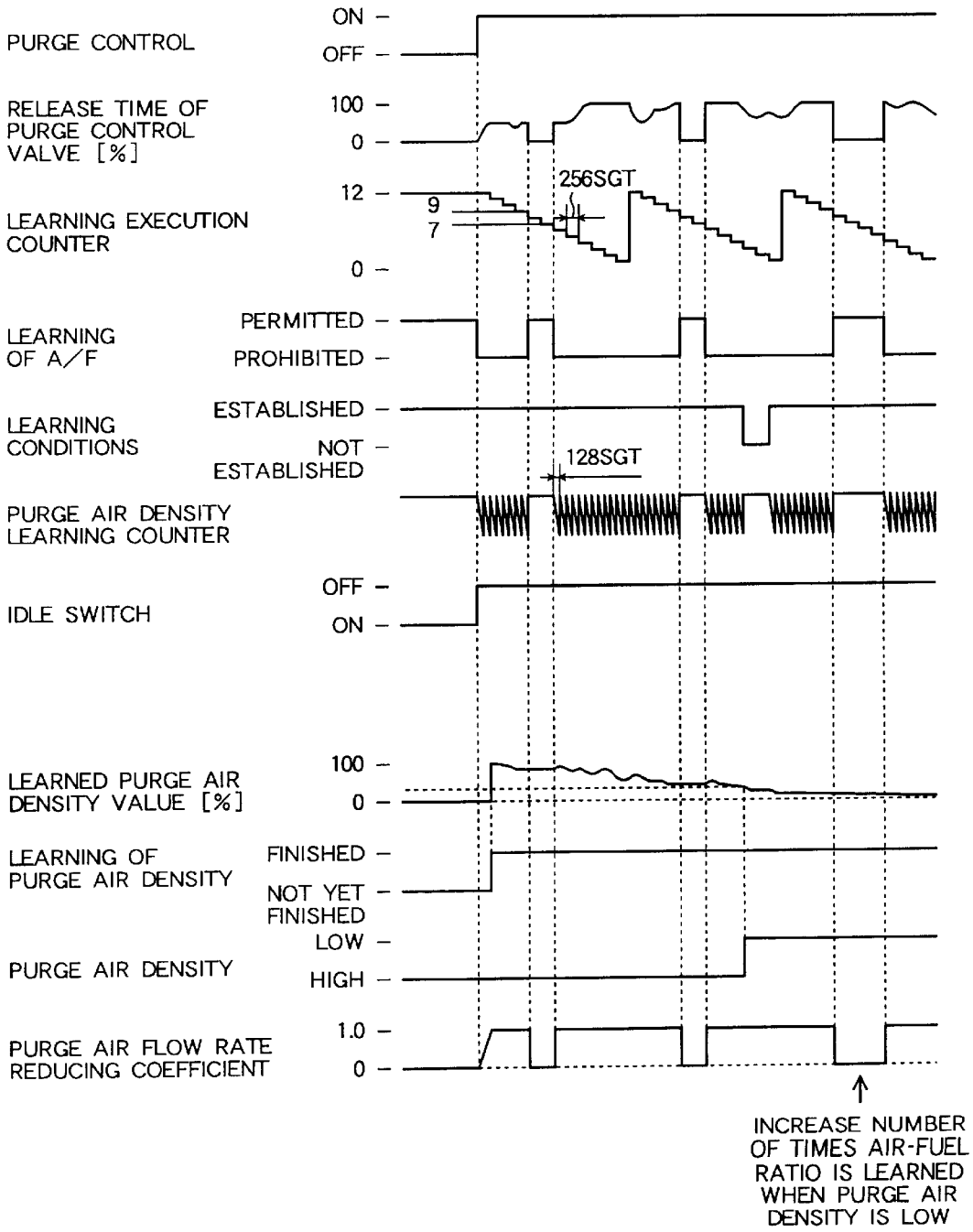
FIG. 11 is a timing chart illustrating the operation of an air-fuel ratio control apparatus according to a second embodiment of the present invention.

FIG. 11 is a waveform view, which is similar to that shown in FIG. 10, for illustrating the operation of an air-fuel ratio control apparatus for an internal combustion engine according to a second embodiment of the present invention. In the second embodiment, when the purge air density is low and the purging operation is sufficiently carried out, the rate at which the air-fuel ratio feedback is learned and corrected is increased to thereby ensure the opportunity for learning it. That is, when the learned purge air density value is equal to or less than a first prescribed value (for example, 1%), the number of times the air-fuel ratio is learned is increased from the number of times (e.g., 2 in the illustrated example) when the learned purge air density value is greater than the first prescribed value to a second prescribed value (e.g., 4 in the illustrated example).

As described above, when the purge air density is low, that is, when the density (pressure) of the evaporated gas in the fuel tank 8 is reduced to the level at which the purge air need not be introduced or discharged from the fuel tank 8 into the intake system, the introduction of the purge air is interrupted. Then, the rate at which the air-fuel ratio is learned is increased to give higher priority to the learning of it. As a result, the number of times the air-fuel ratio is learned is increased without adversely affecting the purge control. With this operation, the accuracy with which the air-fuel ratio feedback control is carried out can be improved by increasing the number of times the air-fuel ratio is learned.

Embodiment 3

Figure 12:
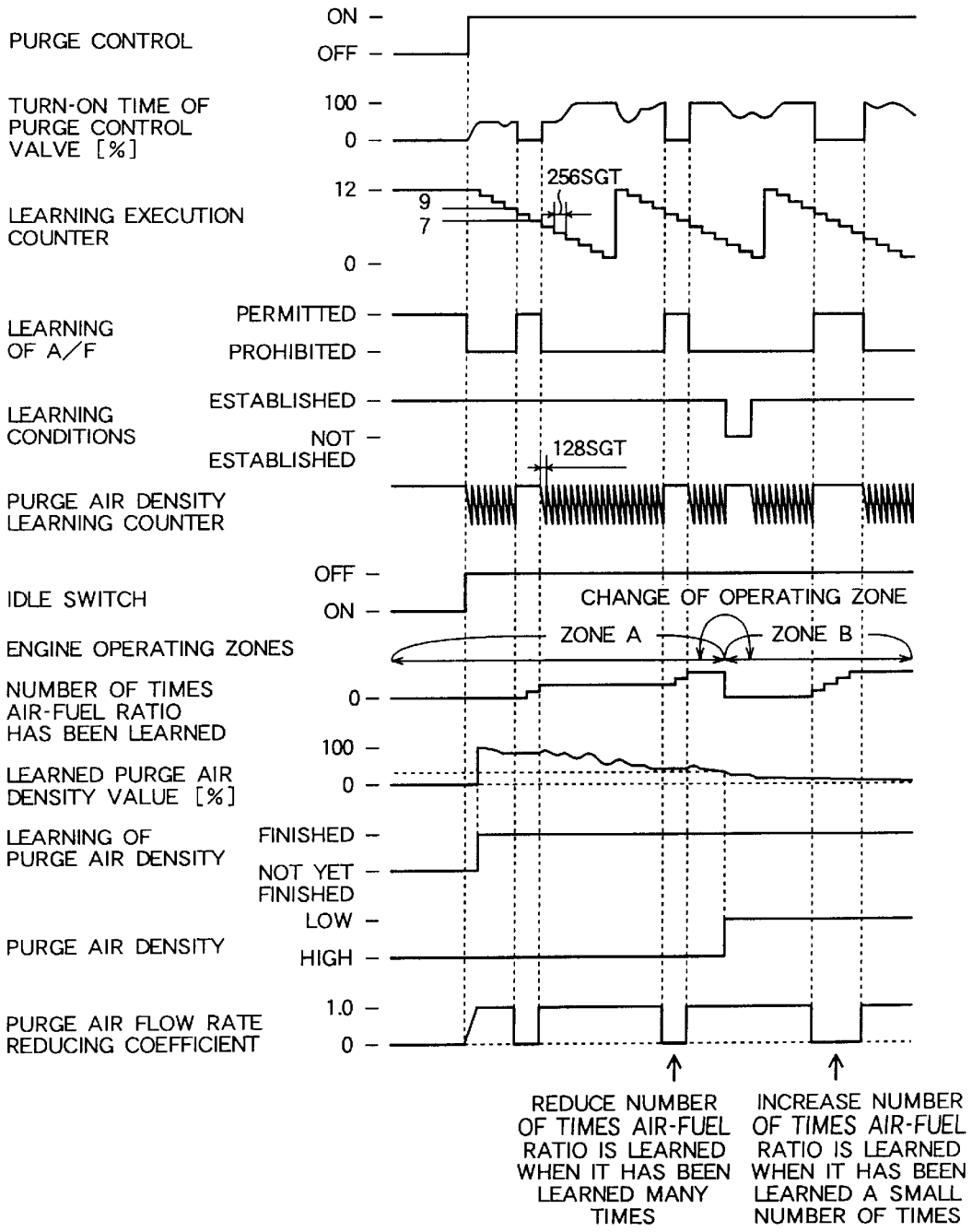
FIG. 12 is a timing chart illustrating the operation of an air-fuel ratio control apparatus according to a third embodiment of the present invention.

FIG. 12 is a waveform view, which is similar to that shown in FIG. 10, for illustrating the operation of an air-fuel ratio control apparatus of an internal combustion engine according to a third embodiment of the present invention.

In the third embodiment, the operating region of the engine is divided into a plurality of zones, e.g., 2 zones A, B in the illustrated example, as shown in FIG. 12. The number of times the air-fuel ratio has been learned in each of the operating zones is stored. The number of times the air-fuel ratio is learned is reduced in the operating zone A in which the air-fuel ratio has already been learned many times. Contrarily, the number of times the air-fuel ratio is learned is increased in the operating zone B in which the air-fuel ratio has been learned a relatively small number of times. More specifically, in the operating zone A in FIG. 12, since the air-fuel ratio has been learned three times in the first learning, the number of times the air-fuel ratio is learned is reduced to 2 times in the subsequent learning. However, when the number of revolutions per minute of the engine is increased and the operating region of the engine is shifted from the operating zone A to the operating zone B, since the air-fuel ratio is not learned in the operating zone B, the number of times the air-fuel ratio is to be learned in the first learning in the operating zone B is increased to 5 times.

In the example illustrated in FIG. 12, the operating region of the engine is divided into a plurality of the operating zones in accordance with the number of revolutions per minute of the engine. However, as shown in FIG. 13, the operating region of the engine may be divided into a plurality of the operating zones in accordance with both the number of revolutions per minute of the engine and the load on the engine (charging efficiency), and the number of times the air-fuel ratio has been learned in each of the operating zones may be stored in the RAM 23.

Figure 13:
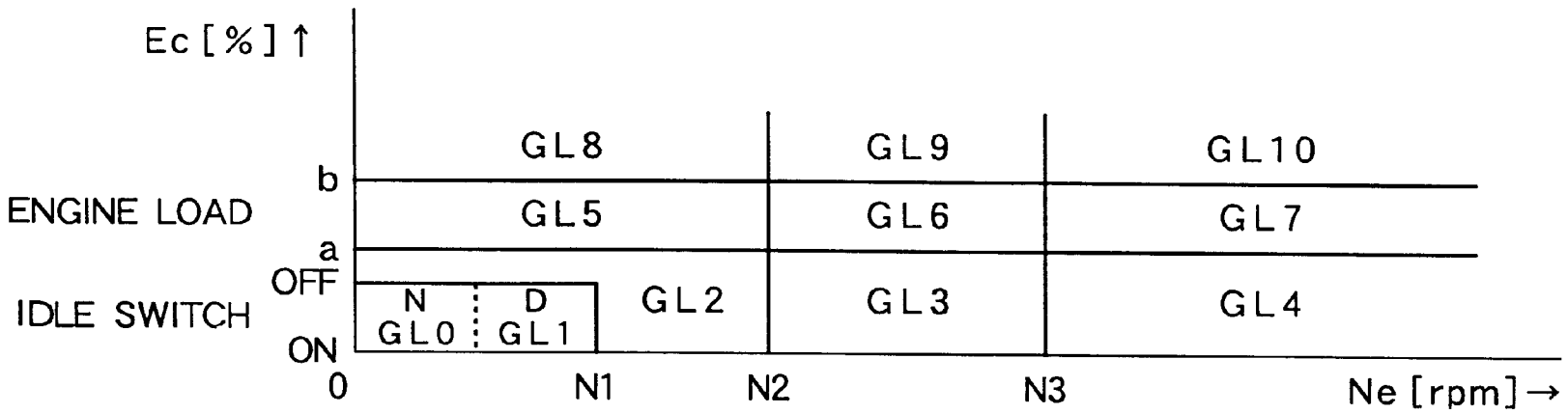
FIG. 13 is a view illustrating an air-fuel ratio control apparatus according to a third embodiment of the present invention, in which an engine operating region is divided into a plurality operating zones and the number of times air-fuel ratio feedback has been learned in each of the operating zones is stored.

Referring to FIG. 13, the operating region of the engine is divided into a plurality of zones (e.g., 11 zones in the illustrated example) in accordance with the threshold values N1, N2 and N3 of the number of revolutions of the engine, depending upon whether the idle switch 13 is turned on or off and whether the shift lever is located in a neutral range N or in a drive range R at the time, and according to the loads a and b on the engine (charging efficiencies). The numbers of times GL0 to GL10 the air-fuel ratio has been learned in the respective operating zones are stored in the RAM 23 in the engine control unit 20. At the time, the learning opportunities in the respective zones vary depending upon the operating state of the engine. To cope with this problem, in an operating zone in which the air-fuel ratio has been learned a small number of times, the learning opportunity is secured by increasing the number of times the air-fuel ratio feedback is learned when the purge air density is low. On the other hand, the number of times the air-fuel ratio is learned is reduced in an operating zone in which the air-fuel ratio has been learned many times.

As described above, the number of times the air-fuel ratio feedback has been learned in each of the operating zones of the engine is stored and the learning ratio is changed based on the number of times the air-fuel ratio has been learned. As a result, the opportunities for learning the air-fuel ratio in the respective operating zones are made equal to each other, whereby the air-fuel ratio feedback control can be effectively carried out in all the operating zones.

Embodiment 4

Figure 14:
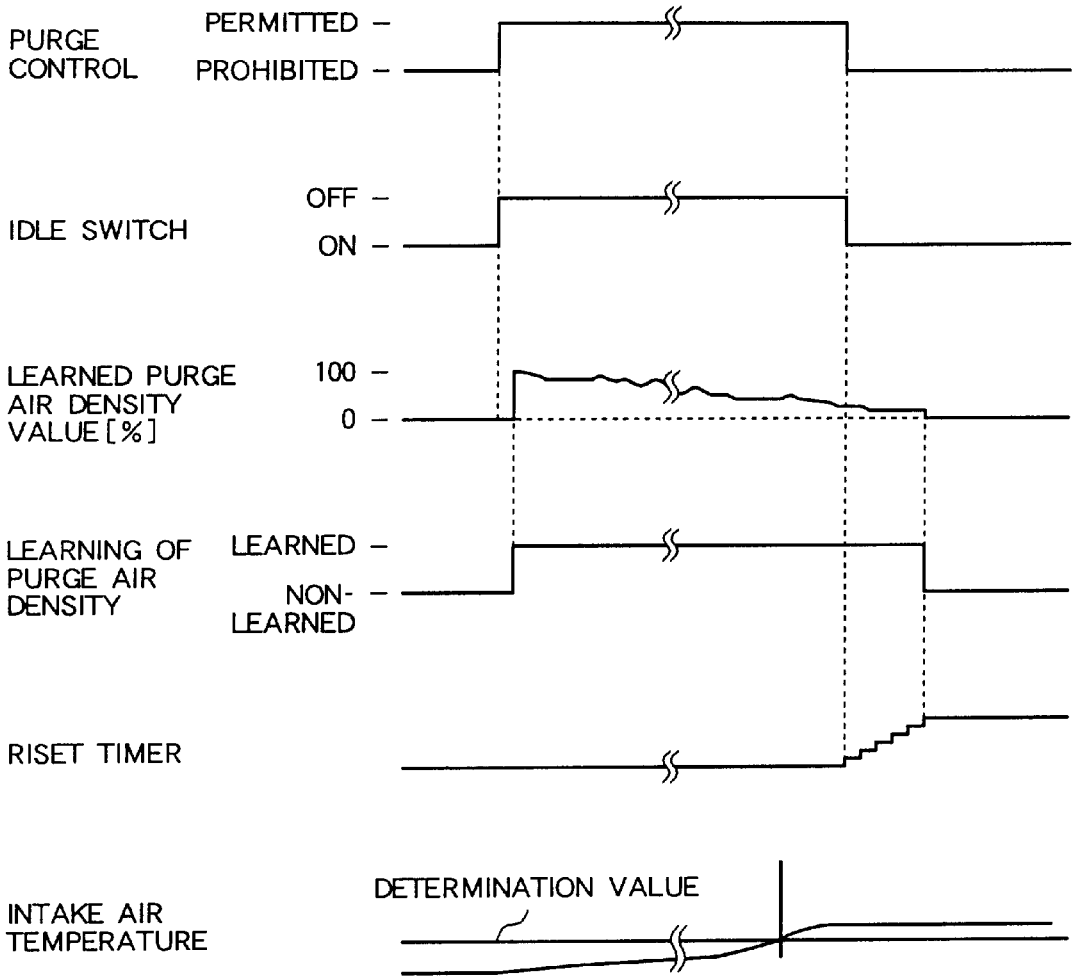
FIG. 14 is a timing chart illustrating the operation of an air-fuel ratio control apparatus according to a fourth embodiment of the present invention.

FIG. 14 is a waveform view for illustrating the operation of an air-fuel ratio control apparatus of an internal combustion engine according to a fourth embodiment of the present invention. In the fourth embodiment, provision is made for a means 40 for determining whether the learned purge air density value is to be reset or not (hereinafter, simply referred to as the determining means). When the determining means 40 detects that a large amount of evaporated gas is generated when the engine is idling at a high temperature, it resets or corrects the learned purge air density.

As shown in FIG. 2, the determining means 40 is supplied with the temperature of intake air which is detected by an intake air temperature sensor (not shown), a signal which indicates whether the idle switch 13 is turned on or off, the fuel level in the fuel tank 8 which is detected by the fuel level gauge 8*b*, the pressure of evaporated gas in the fuel tank 8 which is measured by the fuel tank pressure sensor 8*a*. Based on these pieces of information thus supplied, the determining means 40 determines whether the learned purge air density value is to be reset or corrected.

As shown in FIG. 14, when the idle switch 13 is shifted from a turned-off state to a turned-on state, the purge control is prohibited or interrupted, and at the same time the reset timer incorporated in the determining means 40 is started to operate. If the temperature of the intake air of the engine, which is detected by the intake air temperature sensor, exceeds a prescribed determination value when the count value of the reset timer reaches a prescribed value, the learned purge air density value is reset, and a purge air density learning state is set to a non-learning state. The reason is that when purge air is not introduced for a long time, a large amount of the evaporated gas is generated in the fuel tank 8 due to the idling of the engine at a high temperature, and the like. As a result, it is predicted that the learned purge air density value would be deviated from the actual density of the evaporated gas (evaporated fuel) in the fuel tank 8.

Further, when the purging system is in a closed loop state (i.e., in FIG. 1, the canister atmosphere port 11 is closed and purge air is not discharged into the atmosphere), how much the evaporated gas is generated may be estimated in place of resetting the learned purge air density. Such an estimation can be carried out based on the fuel level in the fuel tank 8, which is measured by the fuel level gauge 8*b*, the pressure of the evaporated gas in the fuel tank 8, which is measured by the fuel tank pressure sensor 8*a*, and the like. Then, the learned purge air density value, which has been stored, may be corrected using the estimated amount of evaporated gas.

With this operation, variations in the air-fuel ratio, which would be caused by a deviation of the learned purge air density value from the actual value thereof when purge air is not continuously introduced, can be effectively prevented.

As described above, the present invention will achieve the following excellent advantages.

According to an air-fuel ratio control apparatus for an internal combustion engine of the present invention, the learning of air-fuel ratio feedback correction and the learning of purge air density can alternately be switched over. Thus, the opportunity for learning the air-fuel ratio feedback correction is made substantially equal or near to the opportunity for learning the purge air density. As a result, both the purging control and the air-fuel ratio control can be finely carried out while establishing compatibility therebetween, taking account of the influences of purge air on the air-fuel ratio upon introduction thereof.

The introduction of purge air is ordinarily prohibited when the air-fuel ratio feedback is learned. When the purge air density is low, however, the air-fuel ratio feedback control can be s carried out while introducing purge air. With this operation, an increase in pressure of the evaporated gas in the fuel tank can be suppressed while ensuring a certain level of purge air flow rate even if the air-fuel ratio feedback control is carried out. At the same time, the learning and correction of air-fuel ratio feedback can be effected with a reduced error.

When the purge air density is low, priority is given to the learning of the air-fuel ratio feedback to thereby increase the rate at which the air-fuel ratio is learned. As a result, the accuracy of the air-fuel ratio feedback control can be improved by increasing the number of times the air-fuel ratio is learned without adversely affecting the purge control.

The rate at which the air-fuel ratio is learned can be changed based on the numbers of times the air-fuel ratio feedback is learned in the respective operating zones of the engine. As a result, the air-fuel ratio can be learned in each of the operating zones at the same opportunity, whereby the air-fuel ratio feedback control can be effectively carried out in all the operating zones.

When the purge air non-introducing mode is switched over to the purge air introducing mode at the time the purge air density has not yet been learned, variations in the air-fuel ratio, which would be caused, upon introduction of purge air, by a deviation between the learned purge air density value and the actual value of the purge air density, can be effectively suppressed by gradually increasing the purge air flow rate.

Further, a large amount of evaporated gas, which would be generated as in a case when the engine is idling at a high temperature, can be detected so that variations in the air-fuel ratio, which would be caused by a deviation between the learned purge air density value and the actual value of the purge air density when purge air has not continuously been introduced, can be effectively prevented by resetting or correcting the learned purge air density.

What is claimed is:

1. An air-fuel ratio control apparatus for an internal combustion engine, comprising:

an operating state detection means for detecting an operating state of the internal combustion engine;

a purge amount control means for controlling an amount of evaporated fuel in a fuel tank to be introduced into an engine intake system based on an output of said operating state detection means;

a purge amount calculation means for calculating a purge amount of the evaporated fuel to be introduced into the engine intake system by said purge amount control means;

a purge rate calculation means for calculating a purge rate based on the purge amount calculated by said purge amount calculation means and based on the engine operating state detected by said operating state detection means;

an air-fuel ratio sensor for detecting an air-fuel ratio of a mixture supplied to the internal combustion engine;

an air-fuel ratio control means for controlling an air-fuel ratio feedback correcting coefficient, which corrects the air-fuel ratio of the mixture to be supplied to the internal combustion engine, based on an output of said air-fuel ratio sensor so as to make the air-fuel ratio to a target value;

a purge air density calculation means for calculating a purge air density based on the purge rate and the air-fuel ratio feedback correcting coefficient;

a purge air density correction means for calculating a purge air density correcting coefficient based on the purge rate and the purge air density;

a learned air-fuel ratio feedback correcting value calculation means for calculating a learned air-fuel ratio feedback correcting value from the air-fuel ratio feedback correcting coefficient;

a fuel injection amount calculation means for calculating a fuel injection amount to be supplied to the internal combustion engine based on the air-fuel ratio feedback correcting coefficient, the learned air-fuel ratio feedback correcting coefficient and the purge air density correcting coefficient; and a switching determination means for alternately switching over between a learning of air-fuel ratio feedback correction and a learning of purge air density.

2. An air-fuel ratio control apparatus for an internal combustion engine according to claim 1, wherein the introduction of purge air is ordinarily prohibited when the air-fuel ratio feedback is learned, whereas when the purge air density is low, air-fuel ratio feedback control is carried out while introducing purge air.

3. An air-fuel ratio control apparatus for an internal combustion engine according to claim 1, wherein when the purge air density is low, priority is given to the learning of the air-fuel ratio feedback to thereby increase the learning rate of the air-fuel ratio.

4. An air-fuel ratio control apparatus for an internal combustion engine according to claim 2, wherein the learning rate of the air-fuel ratio is changed based on the number of times the air-fuel ratio has been learned in each of engine operating zones.

5. An air-fuel ratio control apparatus for an internal combustion engine according to claim 1, wherein when a purge air non-introducing mode is switched over to a purge air introducing mode at the time the purge air density has not yet been learned, a purge air flow rate is gradually increased.

6. An air-fuel ratio control apparatus for an internal combustion engine according to claim 1, further comprising a learned purge air density value resetting determination means for resetting or correcting a learned purge air density when detecting the generation of a large amount of evaporated fuel in the fuel tank.

* * * * *